US009991618B2

(12) United States Patent
Pola

(10) Patent No.: US 9,991,618 B2
(45) Date of Patent: Jun. 5, 2018

(54) CONTACT ELEMENT FOR AN ELECTRICAL CONNECTION

(71) Applicant: Conti Temic microelectronic GmbH, Nuremberg (DE)

(72) Inventor: Olivier Pola, Lavernose (FR)

(73) Assignee: CONTI TEMIC MICROELECTRONIC GMBH, Nuremberg (DE)

( * ) Notice: Subject to any disclaimer, the term of this patent is extended or adjusted under 35 U.S.C. 154(b) by 2 days.

(21) Appl. No.: 15/307,910

(22) PCT Filed: Apr. 28, 2015

(86) PCT No.: PCT/EP2015/059229
§ 371 (c)(1),
(2) Date: Oct. 31, 2016

(87) PCT Pub. No.: WO2015/165914
PCT Pub. Date: Nov. 5, 2015

(65) Prior Publication Data

US 2017/0054235 A1 Feb. 23, 2017

(30) Foreign Application Priority Data

Apr. 30, 2014 (DE) ..... 10 2014 208 226

(51) Int. Cl.
*H01R 12/00* (2006.01)
*H01R 13/03* (2006.01)
(Continued)

(52) U.S. Cl.
CPC ..... *H01R 13/03* (2013.01); *H01R 12/52* (2013.01); *H01R 12/585* (2013.01); *H01R 43/0207* (2013.01); *H01R 43/16* (2013.01)

(58) Field of Classification Search
CPC ..... H01R 12/52; H01R 13/03; H01R 43/16; H01R 12/585; H01R 12/58; H01R 12/718; H01R 12/716; H01R 12/523
(Continued)

(56) References Cited

U.S. PATENT DOCUMENTS 5,980,335 A * 11/1999 Barbieri ..... H01R 13/03 439/824
6,204,065 B1 * 3/2001 Ochiai ..... H01R 13/03 436/66
(Continued)

FOREIGN PATENT DOCUMENTS

DE 1177231 B 9/1964 ..... H01R 13/28
DE 102006031839 A1 1/2008 ..... H01R 4/62
(Continued)

OTHER PUBLICATIONS

German Office Action, Application No. 102014206226.9, 5 pages, dated Apr. 2, 2015.
International Search Report and Written Opinion, Application No. PCT/EP2015/059229, 18 pages, dated Jul. 10, 2015.

*Primary Examiner* — Xuong Chung Trans
(74) *Attorney, Agent, or Firm* — Slayden Grubert Beard PLLC

(57) ABSTRACT

The present invention relates to a contact element for an electrical connection, and to a circuit arrangement having at least one said contact element. A contact element for an electrical connection may include a first contact region of a first copper material for electrically connecting to a first circuit component and a second contact region of a second copper material for electrically connecting to a second circuit component. The first contact region and the second contact region each have a different material hardness, and the two contact regions are interconnected by a materially bonded connection.

13 Claims, 2 Drawing Sheets

(51) Int. Cl.

| | |
|---|---|
| ***H01R 12/52*** | (2011.01) |
| ***H01R 12/58*** | (2011.01) |
| ***H01R 43/02*** | (2006.01) |
| ***H01R 43/16*** | (2006.01) |

(58) Field of Classification Search
USPC ..... 439/74, 82, 751, 886–887, 844
See application file for complete search history.

(56) References Cited

U.S. PATENT DOCUMENTS

| | | | | |
|---|---|---|---|---|
| 7,077,658 | B1 * | 7/2006 | Ashman | H01R 12/523 439/65 |
| 8,579,638 | B2 * | 11/2013 | Schaarschmidt | H01R 12/585 439/82 |
| 8,651,877 | B2 * | 2/2014 | Hougham | H01L 21/486 439/66 |
| 9,331,400 | B1 * | 5/2016 | Bianca | H01R 13/05 |
| 9,455,502 | B2 | 9/2016 | Guenter et al. | |

FOREIGN PATENT DOCUMENTS

| | | | | |
|---|---|---|---|---|
| DE | 102012213812 | A1 | 2/2014 | H01R 12/58 |
| EP | 0945937 | A2 | 9/1999 | H01R 12/71 |
| GB | 968814 | A | 9/1964 | H01R 13/28 |
| WO | 2011/054554 | A | 5/2011 | H01L 21/48 |
| WO | 2015/165914 | A1 | 11/2015 | H01R 12/52 |

* cited by examiner

CONTACT ELEMENT FOR AN ELECTRICAL CONNECTION

CROSS-REFERENCE TO RELATED APPLICATIONS

This application is a U.S. National Stage Application of International Application No. PCT/EP2015/059229 filed Apr. 28, 2015, which designates the United States of America, and claims priority to DE Application No. 10 2014 208 226.9 filed Apr. 30, 2014, the contents of which are hereby incorporated by reference in their entirety.

TECHNICAL FIELD

The present disclosure relates to electrical circuits in general and its teachings may be embodied in a contact element for an electrical connection, and to a circuit arrangement having at least one said contact element. Some embodiments may include a copper strip for producing a plurality of said contact elements.

BACKGROUND

Circuit arrangements comprise circuit components of different types and designs, e.g., circuit carriers, strip conductors, power components or socket contacts. These circuit components must be electrically interconnected, to permit the execution of specific functions by circuit arrangements. To this end, circuit arrangements are provided with contact elements, which are designed for the formation of stable electrical connections between circuit components.

In practice, electrical connections with the various circuit components require different connection methods which, in turn, dictate different mechanical requirements. Contact elements must therefore be designed for the fulfilment of these different mechanical requirements. As is customary in technical devices, requirements for the cost-effective formation of electrical connections between circuit components, in a simple manner, also apply.

SUMMARY

The teachings of the present disclosure may be applied to a simple and cost-effective option for the formation of electrical connections between circuit components.

Some embodiments may include a contact element (KE) for an electrical connection, with a first contact region (B1) of a first copper material for electrically connecting to a first circuit component (LB) and a second contact region (B2) of a second copper material for electrically connecting to a second circuit component (ST2). The first (B1) and second (B2) contact regions have different material hardnesses, and are interconnected by a materially bonded connection (EV).

In some embodiments, the first copper material is up to 110 HV, specifically up to 100 HV, and more specifically up to 95 HV.

In some embodiments, the first copper material is a tough-pitch electrolytic copper (Cu-ETP)

In some embodiments, the second copper material has a material hardness of 130 to 300 HV, specifically of 170 to 200 HV.

In some embodiments, the second copper material contains tin. In some embodiments, the second copper material contains a percentage by weight of tin of 0.15 to 9, and specifically of 5 to 7.

In some embodiments, the first (B1) and the second (B2) contact regions are mutually bonded in an electrically conductive and mechanical manner by an electron beam welded joint (EV).

Some embodiments may include a circuit arrangement (SA), comprising a first circuit component (LB), a second circuit component (ST2), and a contact element (KE) as described above. The first contact region (B1) of the contact element (KE) is connected to the first circuit component (LB) in an electrically conductive and mechanically stable arrangement, by means of a bonded connection (UV), specifically an ultrasound welded joint or soldered joint, and the second contact region (B2) of the contact element (KE) is connected to the second circuit component (ST2) in an electrically conductive and mechanically stable arrangement, by means of a friction-locked connection (PV), specifically a press-fit connection.

Some embodiments may include a copper strip (KB) for producing a plurality of contact elements (KE) as described above, comprising a first longitudinal strip (SR1) of the first copper material, a second longitudinal strip (SR2) of the second copper material, and an electron beam welded joint (EV), which extends in the longitudinal direction (LR) of the first (SR1) and second (SR2) strips, and by means of which the first (SR1) and second (SR2) strips are materially bonded.

BRIEF DESCRIPTION OF THE DRAWINGS

Exemplary embodiments of the teachings herein are described in greater detail hereinafter, with reference to the attached drawings. Herein.

DETAILED DESCRIPTION

Figure 1:
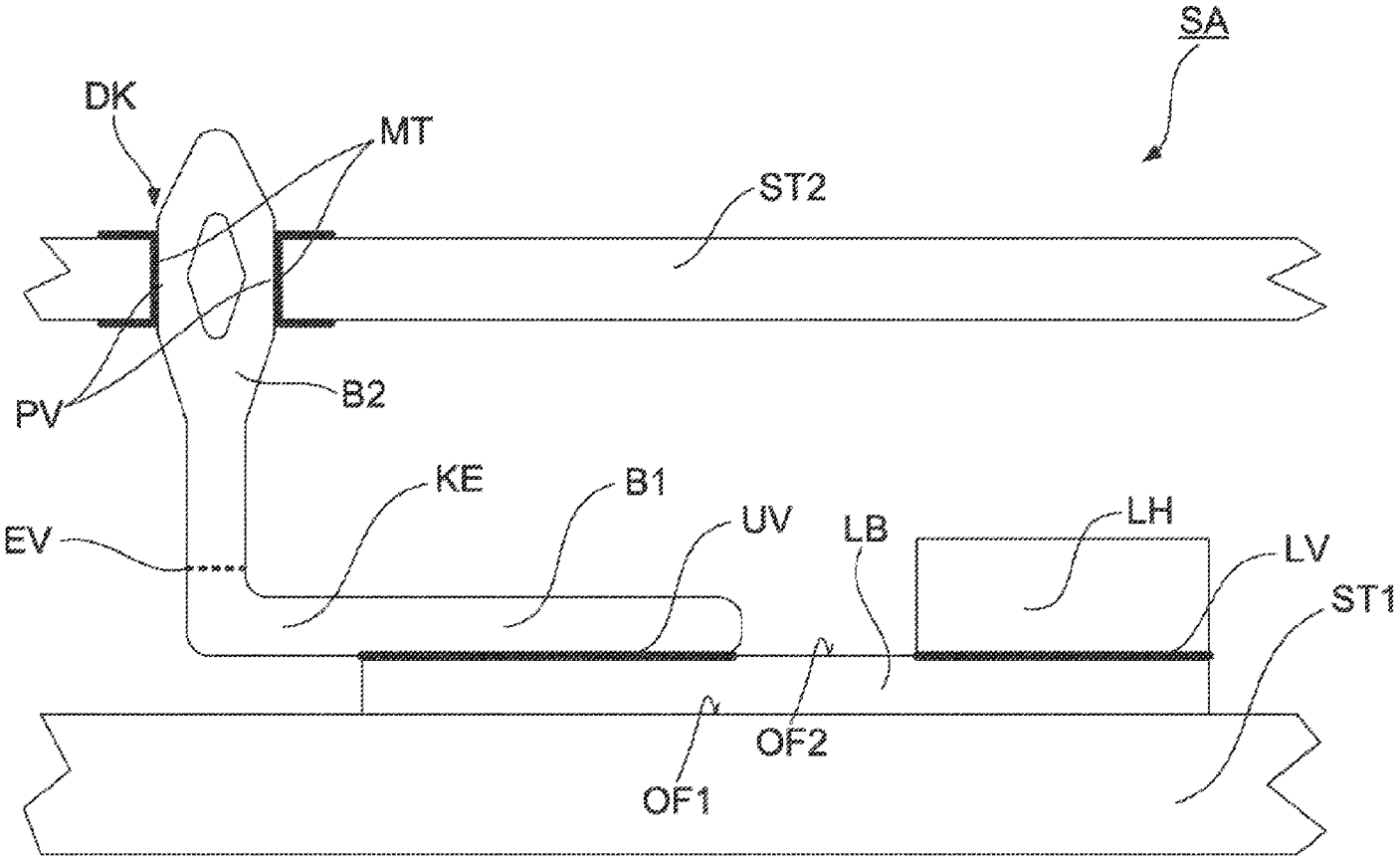
FIG. 1 shows a circuit arrangement with a contact element according to the teachings of the present disclosure, in a schematic side view.

A contact element may comprise a first contact region made of a first electrically conductive copper material (copper or copper alloy) for electrically connecting to a first circuit component. The contact element also comprises a second contact region made of a second electrically conductive copper material (copper or copper alloy) for electrically connecting to a second circuit component. The first and second contact regions may have a different material hardness. Moreover, the first and second contact regions are interconnected by means of a materially bonded connection.

In some embodiments, the respective contact region contains a predominant percentage by weight of the corresponding copper material. Accordingly, the contact element is comprised almost entirely of a copper material, excluding any production-related material impurities or material additives, which protect the contact element against external influences, including e.g., moisture-related corrosion, or against material fatigue.

The term "material hardness" primarily signifies the material resistance of a material. The term "material hardness" in the present application can, secondarily, also signify the strength of a material, which represents the resistance of that material, i.e., of the first or second copper material, to mechanical strain and separation.

In the present application, the phrase "the first and second contact regions are interconnected by means of a materially bonded connection" signifies that the two contact regions are not necessarily mutually adjoining at the point of material bonding, but that a section of the contact element may be present between the two contact regions, through which the bonded connection extends and by means of which the two contact regions are mutually materially bonded.

The first and second contact regions, on their respective contacting sides, are not exclusively comprised of surfaces for full-surface bonding, but may also incorporate exposed surfaces, which are not to be bonded. Specifically, the two contact regions extend mutually in the longitudinal direction of the contact element in a flush-fitted arrangement, wherein the longitudinal direction is arranged transversely or obliquely to the direction of orientation of the materially bonded connection.

For the formation of electrical contact between two circuit components using different connection methods, a contact element with contact regions for the formation of electrical contacts with the two respective circuit components is required in which the two contact zones must fulfill the different mechanical and material requirements dictated by the different connection methods. If the two contact regions are to fulfill these different requirements, they must be comprised of different materials which satisfy the corresponding requirements.

If the contact element is configured with two contact regions of different materials, these two contact regions must be interconnected in a mechanical and electrically conductive arrangement, to form a stable electrical connection between the two circuit components which are electrically interconnected by means of the contact element.

One potential solution, in which the two contact regions are firstly produced as separate components of different electrically conductive materials, and are then interconnected, e.g., by means of screwing, has proved to be both complex and cost-intensive. To permit a simple and cost-effective configuration of electrical connections between circuit components, however, contact elements are mass-produced components, cost-effective and without major complexity.

The present disclosure teaches a materially bonded connection between the two contact regions of a contact element that represents a simple and cost-effective solution. A materially bonded connection permits the stable mechanical connection of contact regions of different materials which, moreover, shows a very low contact resistance at the connection point.

Copper materials, e.g., copper or copper alloy, are suitable for contact regions, in respect of both high electrical conductivity and material bonding. As copper materials can generally be obtained cost-effectively, contact elements with contact regions of different copper material construction can also be manufactured cost-effectively.

The contact elements described herein for electrical connection permits the formation of simple and cost-effective electrical connections between circuit components. In some embodiments, the material hardness of the first copper material is up to 110 HV, specifically up to 100 HV, and more specifically up to 95 HV. The unit of hardness "HV" signifies Vickers hardness.

The copper material with a low material hardness of up to 110 HV, or up to 100 or 95 HV, permits the first contact region to form a materially bonded connection with the first circuit component, without exerting an excessively strong mechanical influence upon the first circuit component.

In some embodiments, the first copper material is an unrefined copper, in accordance with standard DIN EN 1976/98. Specifically, the first copper material may be a tough-pitch electrolytic copper. In some embodiments, the first copper material is a Cu-ETP (or "Electrolytic Tough-Pitch copper"). Cu-ETP, also designated as E-Cu, and previously also as E-Cu58 or E-Cu57, is an oxygen-bearing (tough-pitch) copper produced by electrolytic refining, which shows very high conductivity for both heat and electricity, and is consequently ideally suited for a contact element.

In some embodiments, the second copper material has a material hardness of at least 130 HV, specifically at least 150 HV, or preferably over 170 HV. In some embodiments, the second copper material has a maximum material hardness of 300 HV, specifically not exceeding 250 HV, and in some examples not exceeding 200 HV.

The copper material with a high material hardness exceeding 130 HV or of 130 to 300 HV, specifically of 170 to 200 HV, permits the formation by the second contact region of a simple friction-locked connection, specifically a press-fit connection, with the second circuit component, which can also withstand high mechanical loading.

In some embodiments, the second copper material contains tin in a percentage by weight of over 0.15%, over 1%, and/or over 5%. The second copper material may contain tin in a percentage by weight of up to 22%, up to 20%, up to 15%, up to 12%, up to 10%, up to 9%, and/or up to 7%. The second copper material may comprise a tin bronze, e.g., CuSn6. Tin bronze is also obtainable as a cost-effective mass-produced product in a variety of forms.

In addition to, or in place of tin, the second copper material can contain other additives, including e.g., magnesium, nickel, zinc, and/or silicon.

In some embodiments, copper alloys may be selected for the second copper material which are suitable for the formation of press-fit connections. These include e.g., CuSn0.15, CuSn4, CuSn5, CuSn6, CuMg, CuSn3Zn9, and/or CuNiSi.

In some embodiments, the first and second contact regions are mutually materially bonded by means of an electron beam welded joint. An electron beam welded joint between the two contact regions of different copper materials has an electrical contact resistance which is lower than the electrical resistance in the two contact regions. Moreover, the electron beam welded joint permits the formation of an exceptionally stable mechanical connection between the two contact regions.

Some embodiments include a circuit arrangement comprising a first circuit component and a second circuit component. The circuit arrangement comprises at least one contact element as described above. The first contact region of the contact element is connected to the first circuit component in an electrically conductive and mechanically stable arrangement, by means of a bonded connection, specifically an ultrasound welded joint or soldered joint. The second contact region of the contact element is connected to the second circuit component in an electrically conductive and mechanically stable arrangement, by means of a friction-locked connection, specifically a press-fit connection.

Some embodiments include a copper strip for producing a plurality of the above-mentioned contact elements. The copper strip comprises a first longitudinal strip of a first copper material, and a second longitudinal strip of a second copper material. The copper strip is also provided with a bonded connection, which extends in the longitudinal direction of the first and second strip. By means of the bonded connection, the first and second strips are interconnected in a materially bonded, electrically conductive and mechanically stable manner. The bonded connection is preferably configured as an electron beam welded joint.

The contact elements can be stamped out of a copper strip of this type using a simple stamping machine in a simple stamping process. Advantageous configurations of the above-mentioned contact element, insofar as they are also transferable to the above-mentioned circuit arrangement or the above-mentioned copper strip, are also to be considered as advantageous configurations of the circuit arrangement or copper strip.

Reference is firstly made to FIG. 1, in which a section of a circuit arrangement SA is represented schematically. The circuit arrangement SA comprises a circuit carrier ST1 which, in this form of embodiment, is configured as a ceramic substrate. On one surface OF1 of the circuit carrier ST1, a strip conductor LB is arranged for current transmission, which constitutes a first circuit component of the circuit arrangement SA.

On a surface OF2 of the strip conductor LB facing away from the circuit carrier ST1, a power semiconductor element LH is arranged, such as e.g. a power transistor, which is mechanically and electrically bonded to the strip conductor LB by means of a soldered joint LV. On the same surface OF2 of the strip conductor LB and next to the power semiconductor element LH, a contact element KE is also arranged.

The contact element KE is configured in an L-shape, and has a first contact region B1 and a second contact region B2, which are mutually perpendicular. The first and second contact regions B1, B2 are mutually interconnected in a materially bonded, electrically conductive and mechanically stable arrangement, by means of an electron beam welded joint EV, which is arranged on the bending line of the contact element KE, between the two contact regions B1, B2.

The first contact region B1 lies on the surface OF2 of the strip conductor LB, and is bonded to the strip conductor LB in a mechanical and electrically conductive arrangement by means of an ultrasound welded joint UV. The first contact region B1 is comprised of E-copper (Cu-ETP) and has a material hardness of less than 100 HV (Vickers hardness). The low material hardness of the first contact region B1 reduces the risk of the delamination (debonding or detachment) of the strip conductor LB from the circuit carrier ST1, or of a material failure of the circuit carrier ST1.

The second contact region B2 is configured in the form of a press-fit pin, and is inserted into a metal-plated through-hole DK in a further circuit carrier ST2, which constitutes a second circuit component of the circuit arrangement SA. The second contact region B2 thus forms a friction-locked press-fit connection PV with the metal plating MT on the inner wall of the through-hole DK.

The second contact region B2 is comprised of a tin bronze CuSn6, containing approximately 6 percent by weight of tin, and has a high material hardness in excess of 130 HV (Vickers hardness). The high material hardness of the second contact region B2 permits a stable press-fit connection PV between the contact element KE and the circuit carrier ST2.

Figure 2:
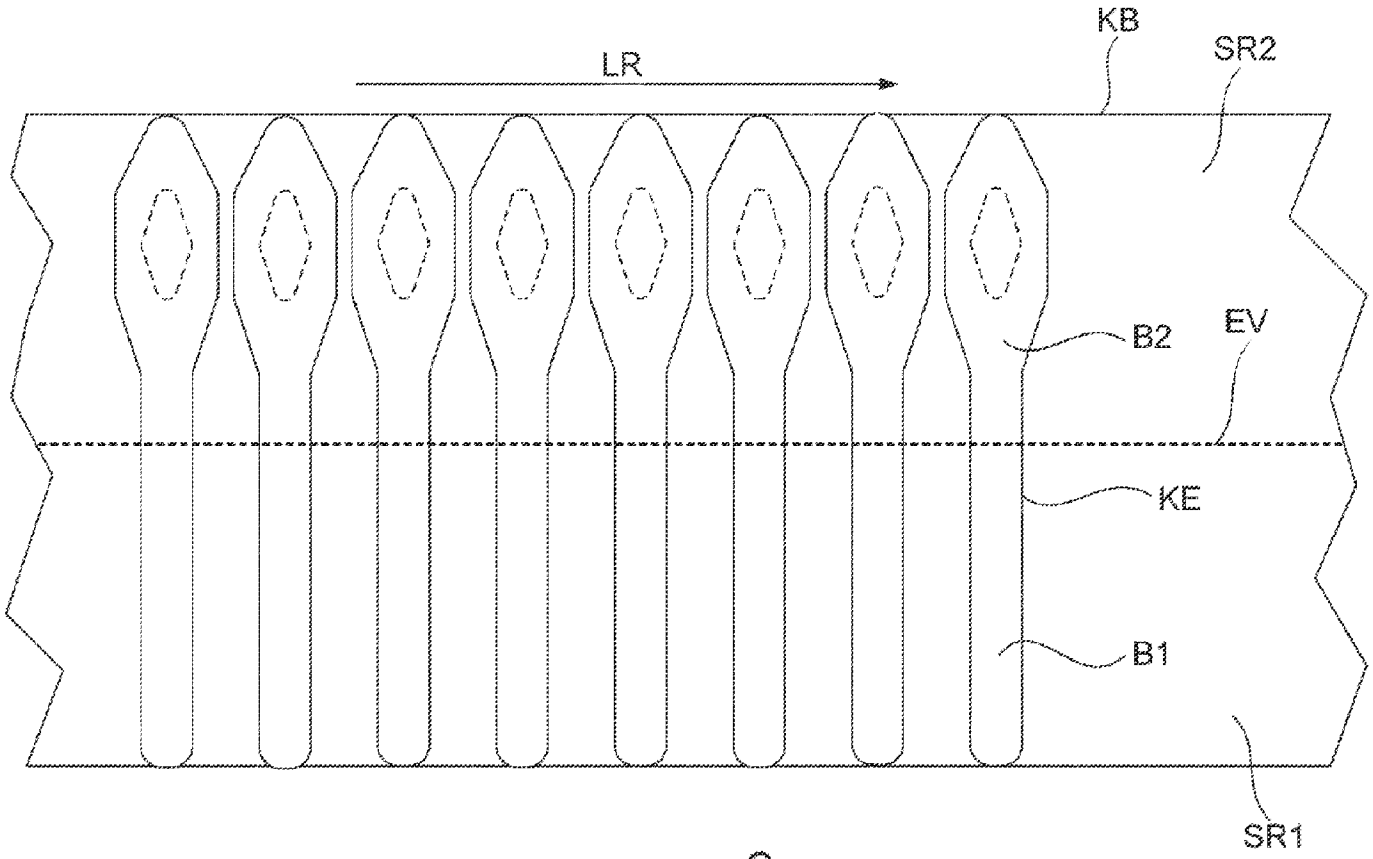
FIG. 2 shows a section of copper strip according to the teachings of the present disclosure, in a schematic overhead view.

Reference is now made to FIG. 2, which schematically represents a section of a copper strip KB for producing a plurality of the contact elements KE represented in FIG. 1. The copper strip KB is configured as a long and narrow strip, and comprises a first longitudinal strip SR1 of the above-mentioned first copper material, namely E-copper (Cu-ETP). The copper strip KB moreover comprises a second longitudinal strip SR2 of the second copper material, namely the tin bronze CuSn6. The first and second strips SR1, SR2 are materially bonded by means of an electron beam welded joint EV, which extends in the longitudinal direction LR of the first and second strips SR1, SR2.

The contact elements KE are stamped out in sequence from the above-mentioned copper strip KB, in the longitudinal direction LR thereof, wherein the sections stamped out of the region of the first strip SR1 form the respective first contact regions B1 of the contact elements KE, and those sections stamped out of the region of the second strip SR2 form the respective second contact regions B2 of the contact elements KE.

Thereafter, the stamped-out contact elements KE are bent into an L-shape at the electron beam welded joint EV. The contact elements KE can thus be manufactured as mass-produced goods in a cost-effective manner, using simple production steps.

What is claimed is:

1. A contact element for an electrical connection, the contact element comprising:

a first contact region of a first copper material for electrically connecting to a first circuit component; and a second contact region of a second copper material having a shape of a press-fit pin for a press-fit electrical connection to a second circuit component;

an electron beam welded joint providing mechanical and electrical connection between the first contact region and the second contact region;

wherein the first contact region and the second contact region each have a different material hardness.

2. The contact element as claimed in claim 1, wherein the first copper material is up to 110 HV.

3. The contact element as claimed in claim 1, wherein the first copper material is a tough-pitch electrolytic copper.

4. The contact element as claimed in claim 1, wherein the second copper material has a material hardness of 130 to 300 HV.

5. The contact element as claimed in claim 1, wherein the second copper material comprises tin.

6. The contact element as claimed in claim 5, wherein the second copper material contains a percentage by weight of tin of 0.15 to 9.

7. The contact element as claimed in claim 1, wherein the first and the second contact regions are mutually bonded in an electrically conductive and mechanical manner by an electron beam welded joint.

8. A circuit arrangement comprising:

a first circuit component;

a second circuit component;

a contact element comprising:

a first contact region of a first copper material for electrically connecting to a first circuit component; and a second contact region of a second copper material having a shape of a press-fit pin for a press-fit electrical connection to a second circuit component;

an electron beam welded joint providing mechanical and electrical connection between the first contact region and the second contact region;

wherein the first contact region and the second contact region each have a different material hardness, and the two contact regions are interconnected by a materially bonded connection;

wherein the first contact region of the contact element is connected to the first circuit component in an electrically conductive and mechanically stable arrangement, by an ultrasound welded joint or soldered joint, and the second contact region of the contact element is connected to the second circuit component in an electrically conductive and mechanically stable arrangement, by a press-fit connection.

9. A copper strip for producing a plurality of contact elements each contact element comprising a first contact region of a first copper material for electrically connecting to a first circuit component and a second contact region of a second copper material having a shape of a press-fit pin for a press-fit electrical connection to a second circuit component, wherein the first contact region and the second contact region each have a different material hardness, and the two contact regions are interconnected by a materially bonded connection, the copper strip comprising:

a first longitudinal strip of the first copper material having a longitudinal axis; and a second longitudinal strip of the second copper material having a longitudinal axis parallel to the longitudinal axis of the first longitudinal strip;

an electron beam welded joint providing mechanical and electrical connection between the first longitudinal strip and the second longitudinal strip.

10. The contact element as claimed in claim 1, wherein the first copper material is up to 100 HV.

11. The contact element as claimed in claim 1, wherein the first copper material is up to 95 HV.

12. The contact element as claimed in claim 1, wherein the second copper material has a material hardness of 170 to 200 HV.

13. The contact element as claimed in claim 5, wherein the second copper material contains a percentage by weight of tin of 5 to 7.

* * * * *